United States Patent [19]

Finn

[11] Patent Number: 4,588,043

[45] Date of Patent: May 13, 1986

[54] SOUND SUPPRESSOR FOR A FIREARM

[76] Inventor: Charles A. Finn, 3204 Production Ave, Suite 1, Oceanside, Calif. 92054

[21] Appl. No.: 684,350

[22] Filed: Dec. 20, 1984

Related U.S. Application Data

[63] Continuation-in-part of Ser. No. 479,690, Mar. 28, 1983.

[51] Int. Cl.[4] ..... F16K 47/02; F16L 55/02

[52] U.S. Cl. ..... 181/223; 181/281; 181/272; 89/14.4

[58] Field of Search ..... 181/248, 223, 264, 281, 181/272; 89/14.4

[56] References Cited

U.S. PATENT DOCUMENTS

| | | | |
|---|---|---|---|
| 1,111,202 | 9/1914 | Westfall | 89/14.4 |
| 1,259,251 | 3/1918 | Love | 181/223 |
| 1,482,805 | 2/1924 | Maxim | 89/14.4 |
| 2,442,773 | 6/1948 | Mason | 181/223 |
| 3,748,956 | 7/1973 | Hubner | 89/14.4 |
| 4,291,610 | 9/1981 | Waiser | 89/14.4 |

*Primary Examiner*—L. T. Hix
*Assistant Examiner*—Brian W. Brown

[57] ABSTRACT

A sound suppressor for a firearm, including a hollow cylindrical casing having an entrance end and an exit end; and at least one disc-shaped baffle element coaxially mounted within the casing and between the ends. The element has front and rear faces with an annular area therebetween and at least one opening in its rear face. A centrally apertured entrance end plug is attached to the entrance end of the casing and is mountable to the muzzle of a firearm. A centrally apertured exit end plug is attached to the exit end of the casing. The baffle element has a primary opening therethrough with at least one slanted sidewall and at least one secondary opening arranged between the annular area and the slanted sidewall.

10 Claims, 13 Drawing Figures

FIG. 5
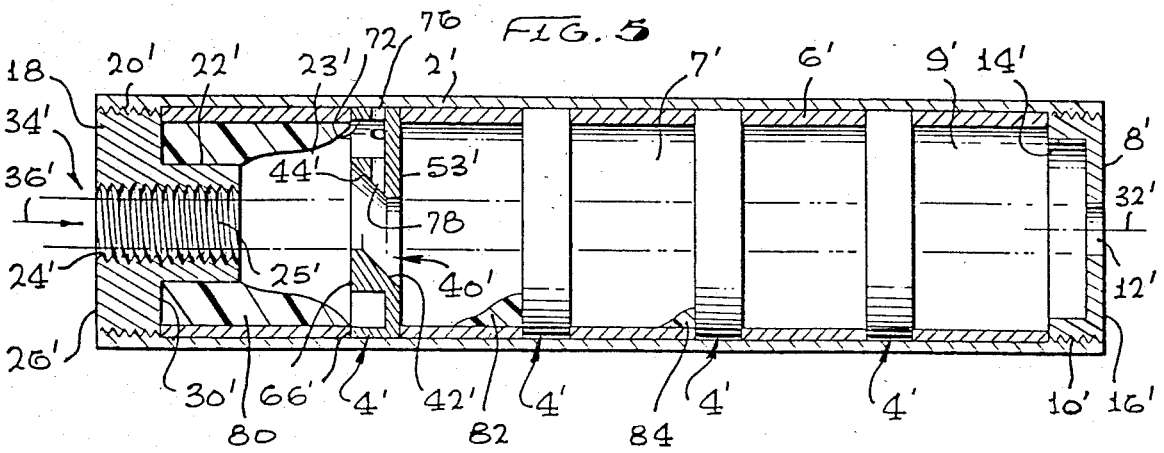
FIG. 6
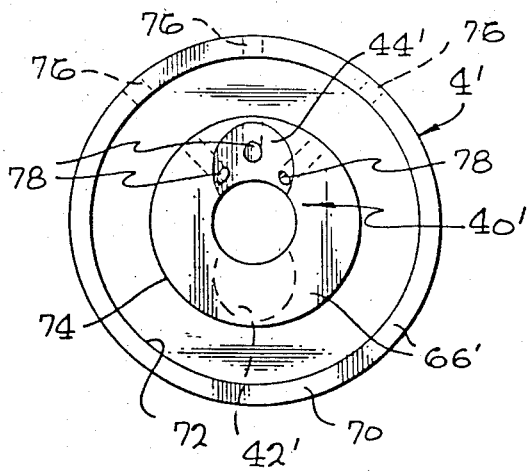
FIG. 7
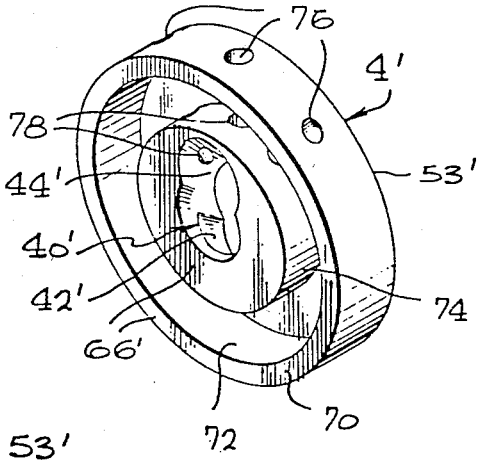
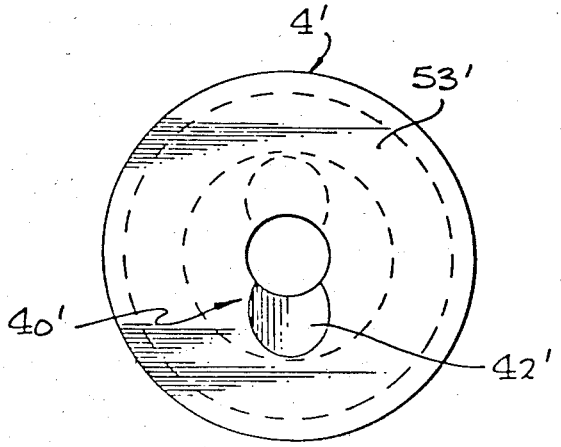
FIG. 8

FIG. 9
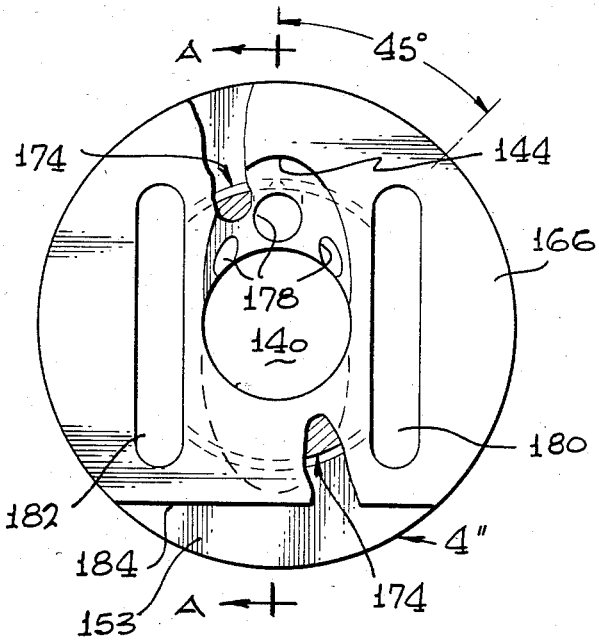
FIG. 10
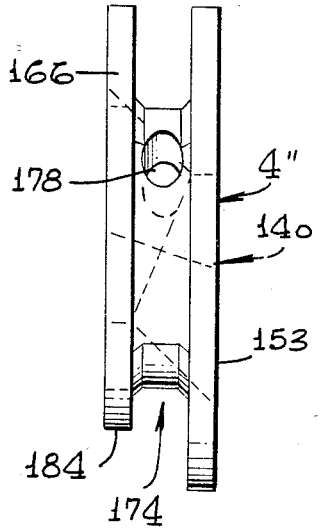
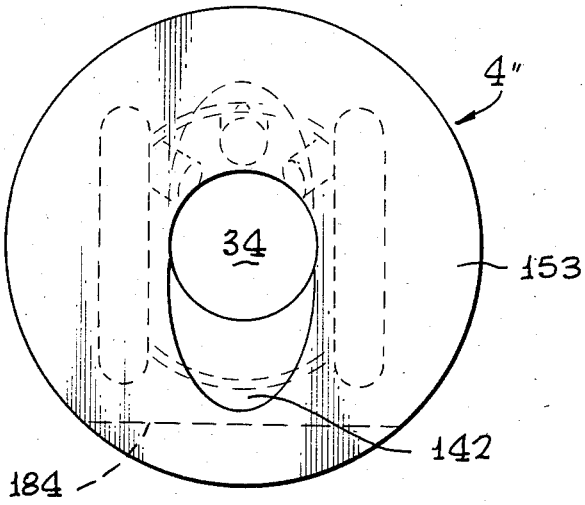
FIG. 11
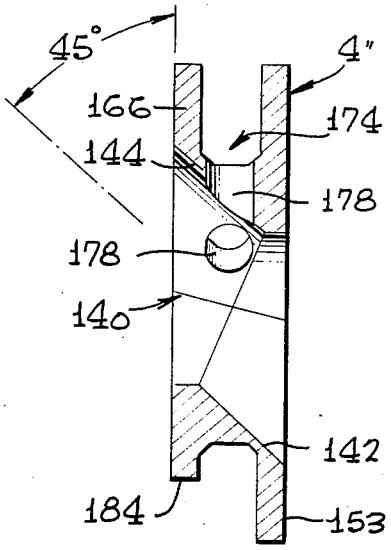
FIG. 12
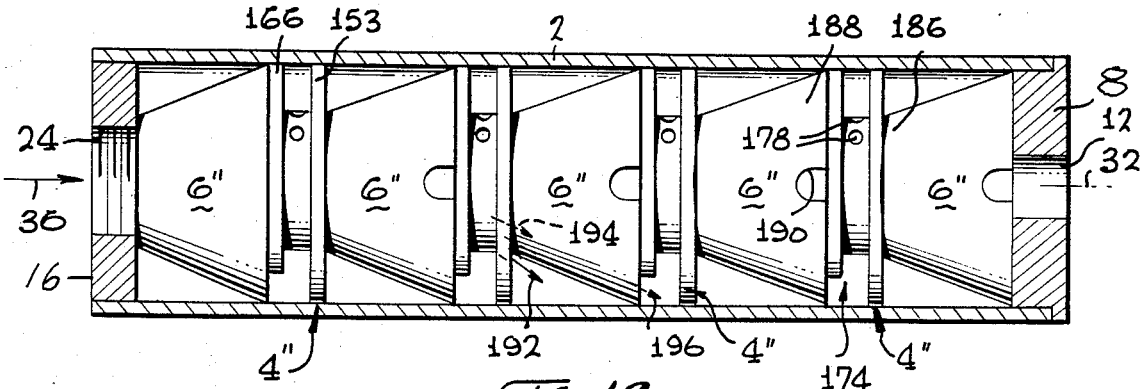
FIG. 13

SOUND SUPPRESSOR FOR A FIREARM

CROSS REFERENCE TO RELATED APPLICATIONS

This application is a continuation-in-part of my prior copending application which bears Ser. No. 479,690 and was filed Mar. 28, 1983.

BACKGROUND OF THE INVENTION

1. Field of the Invention

This invention relates to a sound suppressor or silencer for a firearm. More particularly, the invention relates to a firearm sound suppressor having the form of a cylindrical casing containing a plurality of baffle members which influence the expanding gases associated with the discharge of a projectile from the muzzle of a firearm in a specific fashion to abate the noise otherwise associated with the firing of the firearm.

2. Brief Description of the Prior Art

Firearm silencers are well known in the art of weaponry, and a variety of constructions have been proposed for minimizing the noise associated with expanding gases at the firing of a weapon. One type of silencer construction can be found by reference to U.S. Pat. No. 1,111,202 to W. E. Westfall. Westfall proposes a casing accommodating a plurality of removable funnel-shaped baffle members arranged so that their smaller openings are directed toward the muzzle of the gun barrel. Outwardly curving faces of the baffle members are purported to act as deflecting surfaces for the exhausting gases. However, such surfaces are, in fact, merely guides, and are not in the direct line of movement of the gases. As a result, many of the gases pass straight through the openings in the series of baffle members.

An alternate form of baffle member in a silencer can be found by reference to U.S. Pat. No. 1,482,805 to H. P. Maxim. Maxim uses a similar series of baffle members faced along a cylindrical casing. However, the disc-like portion of each baffle member is constructed of sheet metal having its center hole deformed by offsetting the opposite edges so that the plane of the aperture is inclined to the axis of the casing. With this arrangement, upon firing the gun to which the silencer is attached, the combustion gases are deflected by the deformed portion of the disc-like member and are directed from one chamber to the succeeding one at an angle to the passage for the projectile. There are several shortcomings of the Maxim silencer, however. Of necessity, the disc-portion of each baffle member must be made thin enough to be deformed by, for example, the bending of a shaft fitted through the aperture and forced off axis of the disc. This would tend to buckle the disc, or at least weaken it, and increasing the thickness of the sheet metal baffle member would, at some point, limit the ability to deform the aperture edges. Moreover, by deforming the aperture edges in the manner described by Maxim, the deformed opposite edges of the aperture are out of the plane of the disc, and the resultant area of the opening is increased to a large extent. This is obviously undesirable when the object of the silencer is to impede the movement of gases along the series of baffle members. Furthermore, in view of the necessity for the baffle members to be formed of thin sheet metal, the use of such silencer would be restricted to small firearms with low muzzle exit pressure. Finally, the surfaces off which the gases deflect are in a position to direct the deflected gases toward the aperture of the next baffle.

More importantly, the gases directed by the exit side deformation are directed into the opening in the entrance side deformation of the succeeding baffle member. As a result of these last-two-mentioned physical characteristics, the deflected gases are affected by the deformed disc members in only a small degree, and the gases exiting each baffle member are directed precisely in line with either the aperture or the deformed aperture edge of the succeeding baffle member. Consequently, even with the high number of baffle members illustrated in the Maxim silencer device, the amount of noise reduction is of questionable effectiveness.

The silencer disclosed in U.S. Pat. No. 3,748,956 to Hubner illustrates the use of a series of baffle members which have serrated edges at the passage opening in each baffle member, each serration being bent rearwardly to define a funnel which diverts the gases flowing directly in front of, beside, and behind the projectile. The Hubner silencer thus functions to break up the shock waves produced by the projectile passing through the silencer. The serrated baffles produce a turbulence in the cylindrical column of discharged gases following the projectile and essentially diminishes the energy of the gases by increasing the length of the path taken by the gases before exiting to the atmosphere. The Hubner silencer thus is not adapted to direct the gases passing through the baffle in any specified manner. Rather, Hubner proposes to merely divert the gases prior to exiting each successive baffle member.

In the Waiser U.S. Pat. No. 4,291,610, a series of conical-shaped baffle members are arranged in a manner similar to that described in connection with the Westfall patent. Waiser adds an additional dimension in causing the discharged gases to decrease their energy level by providing a plurality of small holes in a partition member, with the axes of the holes being at an angle with respect to the axis of the silencer. This causes the gases passing therethrough to be directed into the mainstream of gases passing through the main aperture in the center of the silencer device. According to Waiser, the discharged gases are thus separated into a mainstream and into many auxiliary streams with the axes of the auxiliary streams crossing with the axis of the mainstream, resulting in a dispersion of the discharged gases and a decrease of their energy. While the auxiliary streams of the Waiser device are directed into the mainstream of the discharged gases, some of them are angled to direct their discharged gases into the aperture of the downstream baffle member. Accordingly, the gases passing through the auxiliary apertures do not divert the gases away from the opening of the downstream baffle member, in spite of the fact that such auxiliary streams do intersect the axis of the mainstream. Moreover, even in those embodiments which do not direct the auxiliary streams into the opening of the succeeding baffle member, only the partition member is provided with such auxiliary apertures, and the series of baffle members of the Waiser device are devoid of any auxiliary apertures.

SUMMARY OF THE INVENTION

The present invention avoids all of the above-mentioned shortcomings of the prior art sound suppressors by providing a silencer with its baffle elements having an opening therethrough with slanted sidewalls defined by a cylinder whose axis passes through the central axis of the sound suppressor at a predetermined angle so as to direct propulsion gases passing through the opening at a predetermined angle to the central axis. The baffle element further has front and rear surfaces with an annular area therebetween, with openings being provided in the rear surface which communicate with the annular area. At least one opening is provided between the annular area and the slanted sidewalls to enhance the effect of the sidewalls in directing propulsion gases off the central axis of the suppressor.

IN THE DRAWING

Other objects and advantages of the invention will be apparent from the following detailed description of the invention having reference to the accompanying drawings in which:

FIG. 5 is a view similar to that of FIG. 1, but with alternate baffle element and showing the application of a coating of pasty substance within the chambers closest to the entrance end of the suppressor;

FIGS. 6 and 8 are front and rear views of the first alternate baffle;

FIG. 7 is a rear face perspective view of the first alternate baffle;

FIG. 9 is a front view of a second alternate baffle, with small portions of the front cut away to show more clearly the baffles interior construction;

FIG. 10 is a side view of the second alternate baffle;

FIG. 11 is a rear view of the second alternative baffle;

FIG. 12 is a section view taken along line A—A shown in FIG. 9; and

FIG. 13 is a side sectional view of the casing and a side elevational view of the spacers and baffles disposed therein.

DETAILED DESCRIPTION OF A FIRST EMBODIMENT OF THE INVENTION

Figure 1:
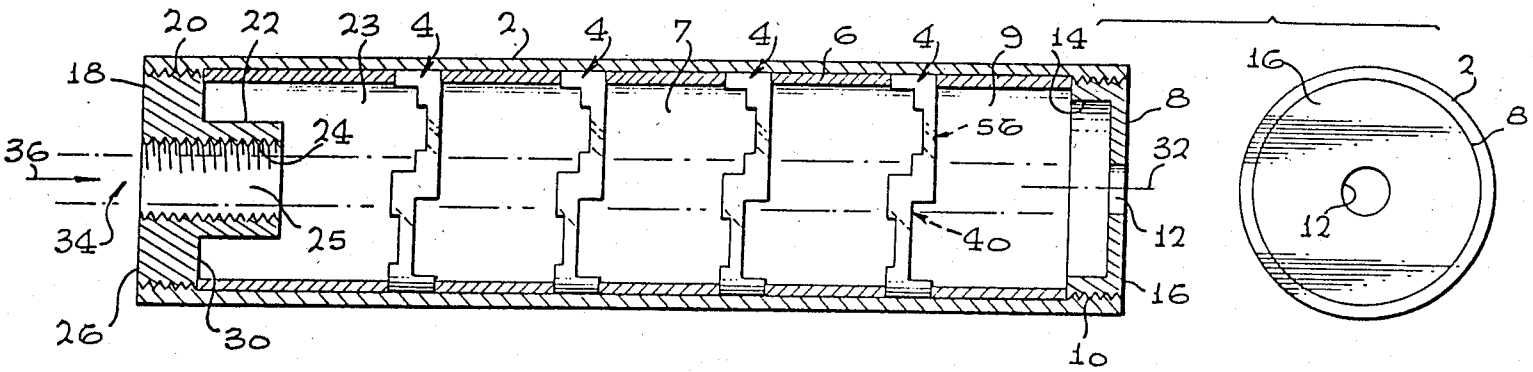
FIG. 1 is a side sectional view of the casing and cylindrical spacer members with elevational side views of the baffle elements spaced along the interior of the casing and an end view of the suppressor.

FIG. 1 shows a first embodiment of the sound suppressor as being comprised of a hollow cylindrical casing 2 with spaced baffle elements 4 serving as partitions within the casing or can 2, creating expansion chambers 7 between baffle elements 4. An entrance end plug 18 and an exit end plug 8 are attached to the ends of the casing 2, preferably by screw threads 20 and 10 respectively.

A convenient and effective, yet inexpensive, means for maintaining baffle elements 4 in a predetermined spacer relationship is shown in FIG. 1 in the form of cylindrical spacer members 6. Spacer members 6 are provided between baffle elements 4 as well as between the end baffle element and the respective end plug 8 or 18. In FIG. 1, the baffle elements 4 are similarly rotationally aligned with respect to the axis 32 of the casing 2. This alignment may be ensured by the provision of mating keying elements (not shown) on the spacer members 6 which engage the channels 46, 48, 50, 54 in the surface of the elements 4. However, there is suggestion that random rotational positioning of the elements 4 may be beneficial, and that option is left to the skilled artisan. In any event, the segregated volumetric chambers within the casing 2 may be referred to as an entrance expansion chamber 23, central expansion chambers 7 between baffle elements 4, and an exit expansion chamber 9. The embodiment of FIGS. 1 and 5 have three central expansion chambers. Those skilled in the art will appreciate that the number of central expansion chambers is a matter of design choice, it being a trade off of the size of the suppressor versus its sound suppression effectiveness.

The end plug 18 is shown with internal threads 24 which may mate with external threads on the end of the firearm muzzle, or may mate with an adaptor that is detachably coupled to the end of a standard firearm. It should be understood that the threaded entrance aperture 25 is merely an illustration of one form of attachment to the firearm, and any number of known attachment means can be used without affecting the effectiveness of the silencer. For example, snap-on, bayonnet, and any secure push-and-latch arrangements can be used. In this connection, the end plugs 8 and 18 may be attached to casing 2 by any secure means, such as by welding, instead of or in addition to the screw threads shown.

A threaded boss 22 may be provided on the entrance plug to increase the gripping strength of the end plug 18 when it serves as a muzzle coupler. When the suppressor is attached to the muzzle end of a firearm (not shown) and secured against entrance end wall 26, a longitudinal projectile passageway 32 is defined aligned with the central extremities of the primary opening 40 in each baffle element 4. The projectile travels through the sound suppressor in the direction of arrow 36 and exits the central discharge aperture 12 in the disc-shaped portion of exit end plug 8. End plug 8 has an exit end wall 16 exposed to the atmosphere, and, in the interest of minimizing weight, is hollowed to form a cylindrical peripheral flange 14 which bears the threaded attachment means in the form of screw threads 10.

Figure 4:
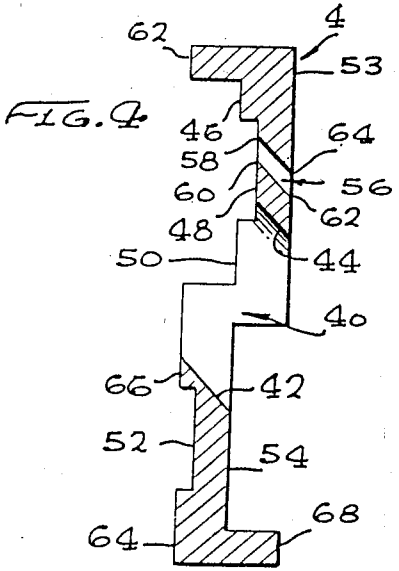
FIG. 4 is a right face elevational view of one of the baffle elements shown in FIG. 1.
Figure 3:
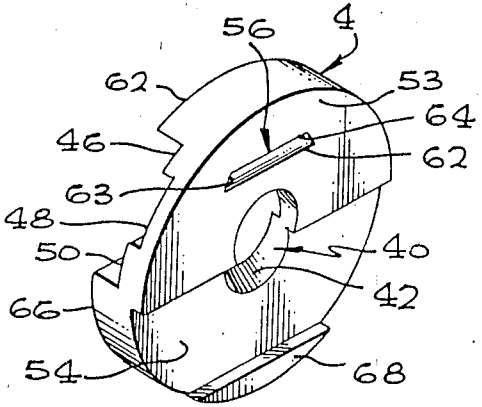
FIG. 3 is a front face perspective view of one of the baffle elements shown in FIG. 1.
Figure 2:
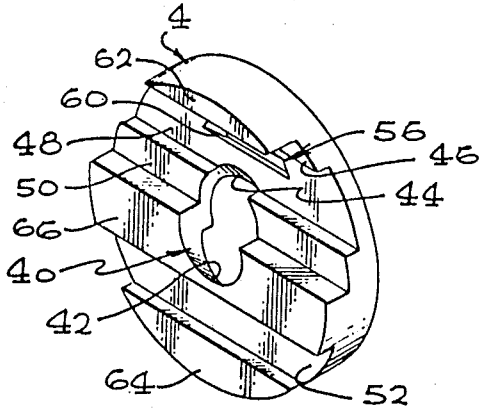
FIG. 2 is a rear face perspective view of a baffle element shown in FIG. 1.

FIGS. 2, 3, and 4 detail the construction of one embodiment of the baffle elements 4. In this embodiment, the baffle element 4 is of solid disc-shaped construction having an opening 40 through which the projectile passes. As best seen in FIG. 4, the opening 40 has slanted sidewalls 42 and 44, defined by the intersection of the disc-shaped baffle element 4 and an imaginary cylinder whose axis passes through the central axis of the baffle element 4 at a predetermined angle. In practice, it has been found advantageous to orient the angle of the sidewalls 42 and 44 at 45 degrees with respect to the central axis 32 of the suppressor. It has also been found advantageous to choose a thickness of the baffle members such that the central extremities of the slanted sidewalls 42 and 44 extend to the periphery of the longitudinal projectile passsageway 34. A facial view of the baffle member would show a substantially circular primary opening 40 for passage of the projectile, yet the angled sidewalls 42 and 44 have substantial axial lengths to impart a large deflection force against the impinging gas stream.

A plurality of rectangular channels are preferably formed in the forward and rear faces 53 and 66, respectively of elements 4. A bi-level rectangular channel is shown as being formed by a first level shallow rectangular channel, 46, 50 the floor of which is recessed by a second level rectangular channel 48. Opposing rectangular channels 52 and 54 are provided on the opposite semi-circular portion of baffle element 4. These channels are judiciously located so as to reduce the weight without losing any structural or functional characteristics of the baffle member.

For example, the upper and lower extremities of the baffle element 4 are maintained at a thick axial dimension by the provision of lips 62, 64, and 68 to aid in maintaining the mechanical integrity of the baffle element. Rectangular channel 52 extends radially inwardly a distance short of inner intersecting sidewall 42 of the primary opening. The same can be seen in the bi-level channel 46 and 48, thereby leaving a substantial mechanical structure for the portion of the baffle through which the primary opening is made.

A secondary opening 56 is shown in FIGS. 2–4 in the form of a partial disc-shaped slot having a lower edge 62, an upper edge 64, and side edges 63 as viewed from the front face 53, and a linear lower edge 60 and an upper circular edge 58 as viewed from rear face 66. The disc-shaped secondary opening 56 is of the shape shown for illustrative purpose only, and, of course, any of a number of different elongated geometrical shapes for the opening are equally suitable for providing the secondary opening to direct the discharged gases downwardly (in FIG. 4) to intersect the axis 2 of the suppressor and, in fact, aid in directing the gases passing through baffle element 4 toward the periphery of the next baffle element downstream.

In a radial cross-section of the baffle element 4 passing through the centers of the primary and secondary opening 40 and 56, the opposite sidewalls of the secondary opening 56 may be inclined at a greater angle to the axis of the baffle element 4 than those of the primary opening 40. It can be seen by reference to FIG. 4 that the thickness of the baffle element 4 at the location of the secondary opening 56 is sufficient to avoid passage of discharge gases therethrough in a direction parallel to the axis of the baffle element 4.

FIG. 5 depicts a second embodiment with an alternative baffle design to be discussed subsequently in detail with respect to FIGS. 6–8 and also shows the expansion chambers nearest the entrance aperture coated with the aforementioned fluid or pasty substance 80 which is preferably a grease such as that used in bearings or gear casings. However, even lighter weight oils or other liquids, including alcohol, liquid detergents, mineral oil, or the like, may be used. I prefer the use of a pasty grease since it does not flow out or drain from the suppressor quite so easily as do the lighter weight oils and fluids. Also, more rounds may be fired before the suppressor must be recharged with grease compared to the lighter weight fluids. However, it appears that the lighter weight fluids provide superior sound suppression compared to grease.

While it is possible to fill each chamber with the fluid, a practical procedure is to fill the suppressor to only 25% to 33% full and preferably to fill entrance chamber 23. As the suppressor is used, and the particles of the fluid 80 are picked up and carried by the exiting gases from one chamber to the next, a deposit 82 of the fluid on the walls of successive chambers will occur as shown in FIG. 5.

Although the fluid 80 is depicted only in FIG. 5, it is to be understood that the fluid is also preferably employed with the sound suppressor of FIGS. 1 and 13 and, indeed, no doubt with other design sound suppressors as well.

The effectiveness of the sound suppressor in accordance with the invention is enhanced by several characteristics of the baffle elements 4, as well as by the provision of the fluid in the chamber 23.

In particular, in the suppressor shown in FIG. 1, the baffles 4 are separated by spacers 6 in order for the baffles to provide the volume in which the gases will flow and expand in a specific fashion as they pass through the baffle into the succeeding downstream expansion chambers 7. Upon firing of the firearm, and passage of the projectile through the primary opening of the first encountered baffle element 4, the pressure of the gas in entrance chamber 23 is substantially greater than the pressure in the first central expansion chamber 7. As a result, the gases will flow through the primary opening 40 and secondary opening 56. As explained in connection with the physical description of the baffle element 4, the openings 40 and 56 are shaped such that the gases traveling through them will be deflected downwardly, (as seen in FIG. 1) from the center line 32 of the suppressor. Since the gas will tend to expand into the area of lowest pressure, the gases directed toward the periphery of the adjacent downstream baffle element 4 will travel away from the main flow stream along center line 32, i.e., up the sides of the baffle element 4 to equalize the pressure in the associated central expansion chamber 7. The pressure on each side of the baffle element 4 do not, in fact, equalize until the pressure throughout the system is returned to ambient pressure. However, in the action which takes place before total atmospheric equalization, the gas flowing away from the primary opening in each baffle will take longer to exit the volume within the expansion chamber 7 downstream from that baffle.

The gases exiting the openings in each baffle member, being directed out of the axis of the suppressor, apparently cause a turbulence within each expansion chamber 7, tending to control expansion of the gases entering each expansion chamber 7 in such a way as to cause the gases to take longer to get into a position to exit the volume through the next baffle element in succession.

The rectangular channels 46, 48, and 52, 54 produce a vertical offset characteristic which contributes to the establishment of a deflecting wall 44 of substantial length, and each channel contributes to the establishment of barriers for the gases flowing past them so as to disrupt the flow, aiding in the creation of turbulence in the moving gases. This apparently slows the moving gases down and provides greater baffle area which, when contacting the hot gases, increases the cooling efficiency of the baffles. This transfer of thermal energy to the large baffle area causes the gases to lower their pressure, thus decreasing the gas flow rate.

By lowering the rate at which gases can flow through the suppressor and providing sufficient gas cooling area, the resultant gas flow to atmosphere at the exit end of the suppressor is at a slow enough rate that the sound pressure level is kept low.

By adding an oil, grease, or other fluid or semi-fluid material 80 to the expansion chambers, especially into or on the interior surfaces of entrance chamber 23, the added material 80 may be partially vaporized by the hot propellant gases, and the density of the gases is thus increased substantially. These denser gases will travel more slowly through the suppressor components, but also through the heat absorption by and transfer to the fluid within the suppressor both, i.e., through vaporization of the fluid and also direct transfer into the fluid increasing its temperature. Moreover, carrying the particulate matter of the vaporized additive material along its flow, the energy in the initial discharge is transformed into kinetic energy to propel the particulate matter.

As mentioned, the density of the gases is increased by the transforming of the fluid-like material 80 to a gas. This gas or smoke, since it is visible, has many suspended particles which increase the weight of the gas per unit volume. Because of the increase in the gas density, the baffles are more efficient in deflecting them from straight line travel. This, in turn, further slows the gas rate of travel through the suppressor and subsequent rate of release to the atmosphere. A lower sound pressure level will result for a suppressor of given size and construction.

While the addition of the fluid material 80 will lower the sound pressure level of any suppressor by lowering gas temperature and increasing the density of the gas thus lowering its rate of travel, it is more effective utilizing the baffle element construction 4, or 4' or 4'' in accordance with the present invention due to the more efficient use of the added density to deflect gas flow away from the primary baffle opening.

In operation, the angled primary opening 40 and angled secondary opening 56 direct the gases out of the straight line of the suppressor. The channels 46, 48, 52, 54 cause the gases within each expansion chamber 7 to move for a longer period of time before exiting the baffle element 4, and these two characteristics of the invention increase the length of travel of the gases before exiting to the atmosphere, thereby contributing to the noise abatement at the discharge end of the suppressor.

The sidewalls of the rectangular channels create barriers in the path of the gas flow; the primary and secondary openings 40, 56 cause the gas to seek paths not in the direct line of the path of the projectile; and the travel of the gases is impeded by contact with movable particulate matter. These effects all contribute to slowing the gas rate of travel through the suppressor and reduce the sound pressure at the exit end of the suppressor.

The suppressor, according to this invention, contains multiple expansion chambers in progression, and the misdirected flow through the primary and secondary openings produce delayed expansion following the frontal shock wave. As a result, the exit pressure is lowered by the expansion processes within the suppressor.

The pressure of the gases is, as suggested, lowered by its cooling through the suppressor. The use of a fluid 80 in the suppressor results in an absorption of heat, and the vaporization of the substance produces a transfer of energy of the gases into thermal and kinetic energy of the fluid. Furthermore, the channels increase the contact area of the baffles adding to the cooling of the gases and consequent lowering of gas pressure. The cooling effect of the increased baffle area is, as has been stated, enhanced by the vehicle of heat transfer by the pasty substance.

The energy of the propellant gas is partially absorbed by contact with the movable particulate matter, and the increased barrier wall surfaces in the path of the gas create additional turbulence to also absorb the gaseous energy by thermal and kinetic energy absorption.

DETAILED DESCRIPTION OF A SECOND EMBODIMENT

Turning to FIGS. 5–8, there is depicted another baffle element 4'. As in the case of the first embodiment disclosed and described with reference to FIGS. 2–4, baffle element 4' is of a solid disc-shaped construction having a primary opening 40' through which the projectile passes. The opening 40' has slanted sidewalls 42', 44', defined by the intersection of the disc-shaped baffle element 4' in an imaginary cylinder whose axis passes through the central axis of the baffle element 4' at a predetermined angle thereto. As in the case of the first embodiment, it has been found advantageous to orient the angle of the sidewalls 42', 44' at about 45 degrees with respect to the central axis 32, 32' of the suppressor (see FIGS. 1 and 5).

An annular channel 72, 74 is provided in the rear face 66' of element 4'. Of course, additional channels may be provided in the rear 66' or forward 53 faces if desired. Annular channel 72' finds at its outer periphery a lip 70 for supporting element 4' within cylindrical casing between spacing members 6'.

A plurality of secondary openings 76, 78 are shown in FIGS. 5–8. Openings 76, 78 are preferably of circular cross-section as they are preferably formed by drilling radially inwardly from the outer lip 70 toward the center of baffle element 4', the secondary openings 76, 78 being circumferentially positioned so that they intersect slanted sidewall 44' of the primary opening 40'. The secondary openings 76 also intersect the inner periphery 74 of the annular channel 72, 74 forming apertures 78 therein.

When the baffle element 4' of FIGS. 6–8 is assembled into a cylindrical casing, the opening 76 in the outer lip 70 it is, of course, blocked by the casing 2'. However, apertures 78 in the inner periphery 74 of the annular channel 72, 74 are exposed, in use, to expanding gases in the immediate upstream expansion chamber and provide an additional path for the flow of the gases. Indeed, those skilled in the art will now appreciate from the foregoing discussion and explanation of the embodimdnt of FIGS. 1–4, that the slanted sidewalls 42', 44' cause the gases passing through the primary opening 50' to deflect away from the axis 32' of the sound suppressor. The gases passing through secondary opening 78 further enhance the deflection of the gases away from axis 32'. As previously mentioned, deflecting the gas away from the axis of the sound suppressor slows the expansion process within the suppressor, which slowing reduces the amount of noise generated when a firearm attached to the suppressor is fired.

In accordance with the present invention, the suppressor comprises a hollow cylindrical casing having an entrance end and an exit end with at least one disc-shaped baffle element coaxially mounted within the casing between the ends. Centrally apertured entrance and exit end plugs are attached to the respective entrance ends and exit ends of the casing. The baffle element has an opening therethrough with slanted sidewalls, the sidewalls defining a cylinder whose axis passes at a predetermined angle to the central axis of the sound suppressor's casing.

The slanted sidewalls deflect the expanding gases within the suppressor from the central axis of the sound suppressor. Preferably, one or more secondary openings are provided in each baffle element between either its rearward facing surface and its forward facing surface or between its rearward facing surface and a slanted sidewall. In any event, the secondary opening or openings are also arranged at a predetermined angle to the central axis of the sound suppressor so as to assist in deflecting the expanding gases away from the central axis of the sound suppressor.

The suppressor of the present invention and particularly the first several chambers therein may experience higher peak internal pressures than do conventional prior art suppressors if a fluid 80 is used in connection therewith, as I prefer to do. Accordingly, I select the materials and thichnesses of the components of my suppressor such that the suppressor will withstand pressures in the range of 30,000–55,000 psi (i.e., pressure also experienced in the chamber of the firearm).

When loading the suppressor with the fluid 80, I preferably fill approximately 25% to 33% of the volume of the suppressor with the fluid 80. Of course, the suppressor can be loaded with a smaller charge of fluid 80, but that only increases the frequency of recharging. By using a grease for fluid 80, I need recharge the fluid only after firing approximately 100 rounds.

DETAILED DESCRIPTION OF A THIRD EMBODIMENT

Turning now to FIGS. 9–12, there is depicted another baffle element 4″. At least one or a plurality of baffle elements 4″ may be assembled into a sound suppressor for a firearm, as is depicted in FIG. 13. As in the case of the first and second embodiments disclosed with respect to FIGS. 2–8, baffle element 4″ is of a solid disc-shaped construction having a primary opening 140 through which the projectile and gases pass. The opening 140 is defined by both a longitudinal projectile passage 34 and by slanted sidewalls 142, 144 which extend near the periphery of the passage way 34. As can be seen with reference to FIG. 9, it has been found advantageous to orient the sidewalls 142, 144 at approximately a 45 degree angle with respect to the central axis 32 of the suppressor.

As can be most clearly seen with reference to FIGS. 10 and 12, the baffle element includes both a front face 153 and a rear face 166. The front face is of a circular configuration (see FIG. 11) and has an outside diameter selected so that the baffle element can be slidingly received in can 2. The rear wall 166 is of a similar diameter but has a cut-off chord depicted at 184 at the bottom thereof. Between the two faces is an annulus 174 which is conceptually similar to the annular channel 172, 174 of the embodiment of FIGS. 6–8. However, in this case the outer wall of the annular area is defined by can 2 and the entrance for gases into the annular area is preferably restricted to the region below cut-off chord 184 and by two longitudinal slots 180, 182 disposed in rear face 166.

A plurality of secondary openings provide fluid communication from the annulus 174 to direct gas therefrom and onto slanted sidewall 142. Openings 178 are preferably circular in cross-section as they are preferably formed by drilling radially inwardly from the annulus 174 toward the center of the baffle element 4″, the secondary openings 178 being circumferentially positioned so that they intersect the slanted sidewall 144 of the primary opening 140, and further their axes preferably intersect slanted sidewall 142.

When the baffle element 4″ of FIGS. 11–12 is assembled into a cylindrical casing or can 2, spacers 6 of the type depicted in FIG. 1 may be used, or preferably conical spacers 6″ of the type depicted in FIG. 13 may be used between them. Whichever type of spacer is used, apertures 178 are exposed, in use, to expanding gases in the immediate upstream expansion chamber, provide an additional path for the flow of gases. Indeed, those skilled in the art will appreciate from the foregoing discussion and the explanation of the embodiments of FIGS. 1–4 and FIGS. 6–8 that the slanted sidewalls 142, 144 cause the gases passing through opening 140 to deflect away from the axis 32 of the sound suppressor. The gases passing through the secondary openings 178 further enhance the deflection of the gases away from axis 32. Deflecting the gas away from the axis of the sound suppressors slows the expansion process within the suppressor, which slowing reduces the amount of noise generated when a firearm attached to the suppressor is fired.

When using conical spacers 6″ as shown in FIG. 13, such spacers are preferably designed such that the smaller diameter end thereof 186 confronts front face 153 of one adjacent baffle element 4″ while the large diameter end 188 of spacer 6″ confronts the rear face 166 of the other adjacent baffle element 4″. Moreover, smaller diameter end 186 of the baffle element is selected to have a radius which is smaller than the maximum radial extent of slanted wall 142 so that a portion 192 of the gases exiting opening 140 are discharged into the area between the outer surface of spacer 6″ and can 2. A plurality of small notches 190 are preferably provided near the forward edge 188 of the cone in order to permit the gases 192 to pass between the outer surface of the cone 6 and the inner surface of the can 2 to progress forwardly through the suppressor. Additional gases 194 are directed at an acute angle to the axis 32 of the suppressor, progressing along the inner, lower surface of the cone 6 toward the foot of the next baffle 4″. A portion 196 of these last-mentioned gases 194 pass under edge 184 of the baffle element and into annulus 174 from which point the gases travel circumferentially upwards toward openings 178 from which the gases exit the baffle element toward its slanted surface 142 causing the gases passing through opening 140 to have a greater downward component than that which is contributed by slanted surfaces 144 and 142 alone.

The suppressor of FIG. 13, consistent with the suppressors of FIGS. 1 and 5, is shown with solid apertured end walls 8 and 18. If desired, and in order to further improve the sound suppression capablity of the suppressor, the front wall 8 may be replaced with a baffle element, such as baffle element 4″, modified as needed to properly mate with the end of can 2.

Having described the invention with respect of certain specific enbodiments thereof, modification may now suggest itself to those skilled in the art. Such modifications to the basic invention can be effected without departing from the scope and spirit of the invention. Accordingly, it is to be understood that the invention will be limited only by the appended claims.

I claim:

1. A sound suppressor for a firearm, comprising:

a hollow cylindrical casing having an entrance end and an exit end;

at least one disc-shaped baffle element coaxially mounted within said casing and between said ends, said element having front and rear faces with an annular area therebetween and with at least one opening in said rear face;

a centrally apertured entrance end plug attached to the entrance end of said casing and including means for mounting said sound suppressor to the muzzle of a firearm; and a centrally apertured exit end plug attached to the exit end of said casing;

said baffle element having a primary opening therethrough with at least one slanted sidewall and at least one secondary opening arranged between said annular area and said slanted sidewall.

2. The sound suppressor as claimed in claim 1, including:

a plurality of said baffle elements coaxially mounted within said casing between said casing ends in spaced relationship; and a plurality of spacer members telescopically slidable within said casing, said spacer members extending between one of said end plugs and the corresponding face of the outermost baffle members, and additional ones of said spacer members extending between the outer peripheries of the faces of adjacent baffle elements.

3. The sound suppressor of claim 2, wherein said spacer members are generally defined by truncated cones.

4. The sound suppressor of claim 3, wherein said truncated cones have a large diameter end and a small diameter end, the radius of the small diameter end being less than the radial extent of the slanted sidewall of the primary opening where it intersects the front face of the baffle element, whereby a first portion of the gases exiting the primary opening enter the adjacent cone and a second portion of the gases exiting the primary opening pass outside the adjacent cone.

5. The sound suppressor of claim 4, wherein said truncated cones have at least one opening therein disposed adjacent said large diameter end and arranged to pass said second portion of the gases exiting the primary opening.

6. The sound suppressor of claim 4 wherein said at least one opening in said rear face is provided by spacing a portion of the periphery of the rear face from said casing.

7. The sound suppressor of claim 6, wherein said portion has the same angular orientation with respect to the axis of the suppressor as the maximum radial extent of the slanted sidewall on the front face.

8. The sound suppressor of claim 4, wherein said at least one opening in said rear face is provided by a pair of openings disposed radially inwardly of the periphery of the rear face.

9. The sound suppressor as claimed in claim 1, wherein:

spaces within said casing between said baffle elements and between said baffle elements and said end plugs define a series of expansion chambers into which the projectile and discharged gases from said firearm muzzle pass, and entrance expansion chamber defined between said entrance plug and its adjacent baffle element, central expansion chambers defined between adjacent baffle elements, and an exit expansion chamber defined between said exit end plug and its adjacent baffle element; and longitudinal spacing of said baffle elements and said predetermined angle are chosen such that the discharged gases impinging upon said slanted sidewall of said baffle element opening direct the gases generally toward the point of contact between said baffle elements and said casing within said central expansion chambers, and toward the point of contact between said exit end plug and said casing within said exit expansion chamber.

10. The sound suppressor of claim 1, wherein said at least one secondary opening has an axis that is disposed at approximately a right angle to the central axis of said casing.

* * * * *